US005765238A

United States Patent [19]

Furukawa et al.

[11] Patent Number: 5,765,238

[45] Date of Patent: Jun. 16, 1998

[54] HUMAN PRIVATE PARTS WASHING APPARATUS

[75] Inventors: Hideki Furukawa, Toyota; Yuji Yamaguchi; Mitsuhiro Ohara, both of Anjo; Shinji Kawai, Toyota, all of Japan

[73] Assignee: Aisin Seiki Kabushiki Kaisha, Kariya, Japan

[21] Appl. No.: 19,348

[22] Filed: Feb. 18, 1993

Related U.S. Application Data

[63] Continuation of Ser. No. 716,989, Jun. 18, 1991, abandoned.

[30] Foreign Application Priority Data

Jun. 18, 1990 [JP] Japan ..... 2-64333 U

[51] Int. Cl.[6] ..... A47K 3/20

[52] U.S. Cl. ..... 4/420.4

[58] Field of Search ..... 4/420.4

[56] References Cited

U.S. PATENT DOCUMENTS

| | | | |
|---|---|---|---|
| 4,094,018 | 6/1978 | Bemthin | 4/420.4 |
| 4,551,868 | 11/1985 | Kawai et al. | 4/443 |
| 4,581,779 | 4/1986 | Matsui et al. | 4/420.4 X |
| 4,628,548 | 12/1986 | Kurosawa et al. | 4/420.4 |
| 4,704,748 | 11/1987 | Takeda et al. | 4/420.4 |
| 4,987,617 | 1/1991 | Furukawa et al. | 4/420.4 X |
| 5,050,249 | 9/1991 | Takeda et al. | 4/420.4 X |

FOREIGN PATENT DOCUMENTS

| | | |
|---|---|---|
| 2500345 | 7/1976 | Germany . |
| 3336461 | 10/1985 | Germany . |
| 60-253634 | 12/1985 | Japan . |
| 61-26778 | 2/1986 | Japan . |
| 62-242030 | 10/1987 | Japan . |
| 84/01973 | 5/1984 | WIPO . |

OTHER PUBLICATIONS

Takeda et al. 60–253634 ('634), English translation, Dec. 14, 1985, 20 pages.

*Primary Examiner*—Robert M. Fetsuga

*Attorney, Agent, or Firm*—Oblon, Spivak, McClelland, Maier, & Neustadt, P.C.

[57] ABSTRACT

A human private parts washing apparatus includes a first nozzle device having a first splashing opening for washing the first position, a second nozzle device having a second splashing opening that is opened on a position end thereof for washing the second position, a case having the first nozzle device and the second nozzle device therein, a stand for mounting thereon the first nozzle device and the second nozzle device, and a driving device for driving the stand back and forth.

4 Claims, 3 Drawing Sheets

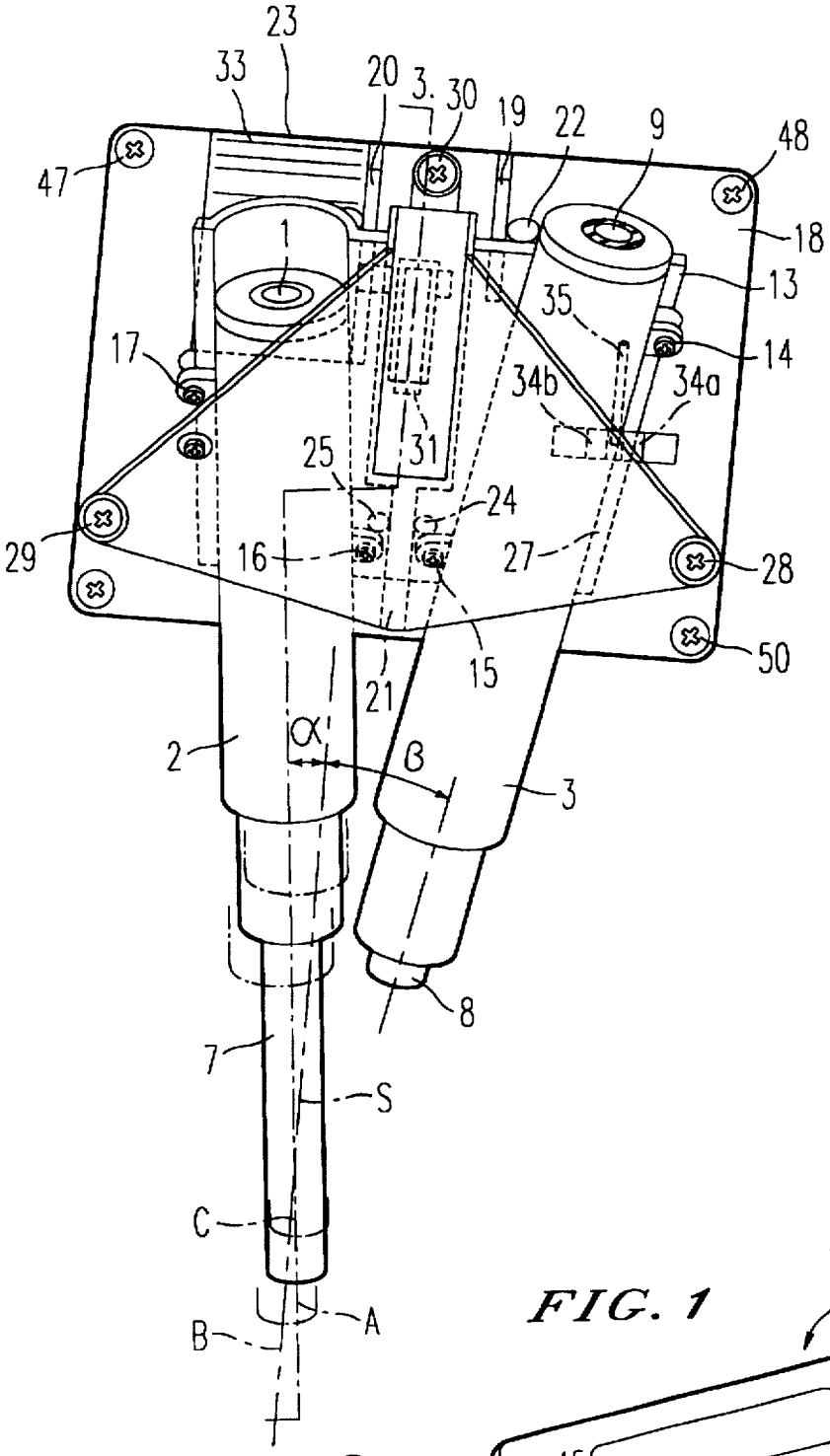
FIG. 2
FIG. 1
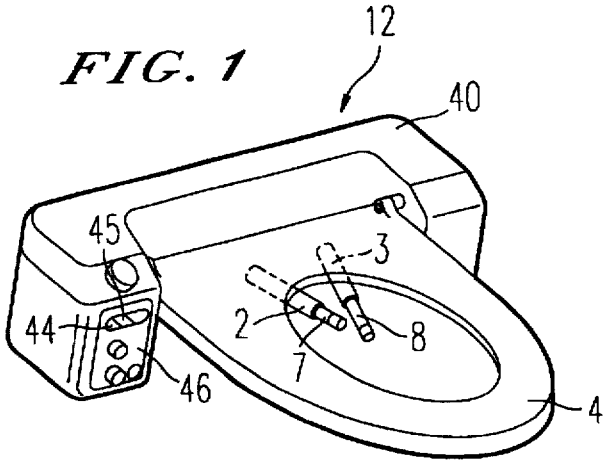

HUMAN PRIVATE PARTS WASHING APPARATUS

This application is a continuation of application Ser. No. 07/716,989, filed on Jun. 18, 1991, now abandoned.

BACKGROUND OF THE INVENTION

1. Field of the Invention

This invention relates to a human private parts washing apparatus installed to a toilet bowl.

2. Description of the Related Art

A human private parts washing apparatus disclosed in Japanese Utility Model Laid-Open No. 26778/1986 has been known as one of the human private parts washing apparatus of this type. This apparatus has two washing nozzles arranged to extend up and down in a case, and each nozzle is used for washing an anus region (hereinafter denoted simply first position) and for washing a bidet (hereinafter denoted simply second position). Each nozzle has a wire means driven by a motor. When a user puts on a switch in order to wash the first position, the nozzles are extend from an opening of the case to the first position by the motor. A fine adjustment of the washing position is controlled by moving the wire.

The above mentioned appratus makes it possible to splash an amount of washing water from the nozzle at a center of a lavatory seat because each nozzle is arranged to extend up and down. However the opening of the case becomes vertical so that filthy water and a detergent and the like enter to the opening easily on using or cleaning of this apparatus. It causes a short circuit and breakdown. Moreover the length of the whole apparatus from top to bottom becomes long so that the height of the lavatory seat becomes high. It is not useful for children and the user who is of a short height. And further, this apparatus needs many parts such as pulleys because the wires are used for driving, and the motor which drives two nozzles by using the wires and pulley needs high torque because of produced mechanical friction. It has drawbacks that the parts which comprise a driving machine of the nozzles become large in number.

In order to solve the above problem, a washing apparatus disclosed in Japanese Patent Laid-Open No. 242030/1987 has been known as the other private parts washing apparatus. This apparatus has one nozzle which washes both the first position and the second position, and a rack which meshes with a pinion is installed under the nozzle. A shaft of the pinion is mounted to a motor. The nozzle is extended to the washing position by driving the motor. However, this apparatus has a problem that the nozzle can't keep clean. This is caused by the following reason. The nozzle has two kinds of splashing openings, one is opened on a position end of the nozzle for washing the second position and the other is opened at the back of said openings for washing the second position. So that it may occur that filth adheres on the nozzle on washing the second position.

SUMMARY OF THE INVENTION

It is an object of the invention to provide a human private parts washing apparatus which obviates the above conventional drawbacks.

It is another object of the invention to provide an improved human private parts washing apparatus in which filth and a detergent don't enter the opening of the case.

It is the third object of this invention to keep the nozzle clean.

It is the forth object of this invention to wash the first position and the second position correctly.

In order to attain the foregoing objects, a human private parts washing apparatus according to this invention comprises a case mounted in proximity to the toilet bowl, a stand movably mounted to the case for movement between a stand retracted position and at least one stand advanced position, drive means for driving the stand between the stand retracted position and at least one stand advanced position, two nozzle holders mounted to the stand for movement with the stand between the retracted and the at least one advanced position, first and second nozzles having first and second splashing openings and being respectively mounted in the nozzle holders for movement from nozzle retracted positions to nozzle advanced positions in which the splash openings are positioned for splashing water onto the respective human private parts, together with means for independently moving the first and second nozzles between the retracted and advanced positioned thereof.

BRIEF DESCRIPTION OF THE DRAWINGS

The above and other objects, features and advantages of the present invention will be more apparent and more readilly appreciated from the following detailed description of preferred exemplarly embodiments of the present invention, taken in connection with the accompanying drawings, in which;

FIG. 1 is a view illustrating a human private parts washing apparatus according to this invention;

FIG. 2 is a plan view showing a nozzle unit of a preferred embodiment according to this invention;

DESCRIPTION OF THE PREFERRED EMBODIMENTS

Figure 3:
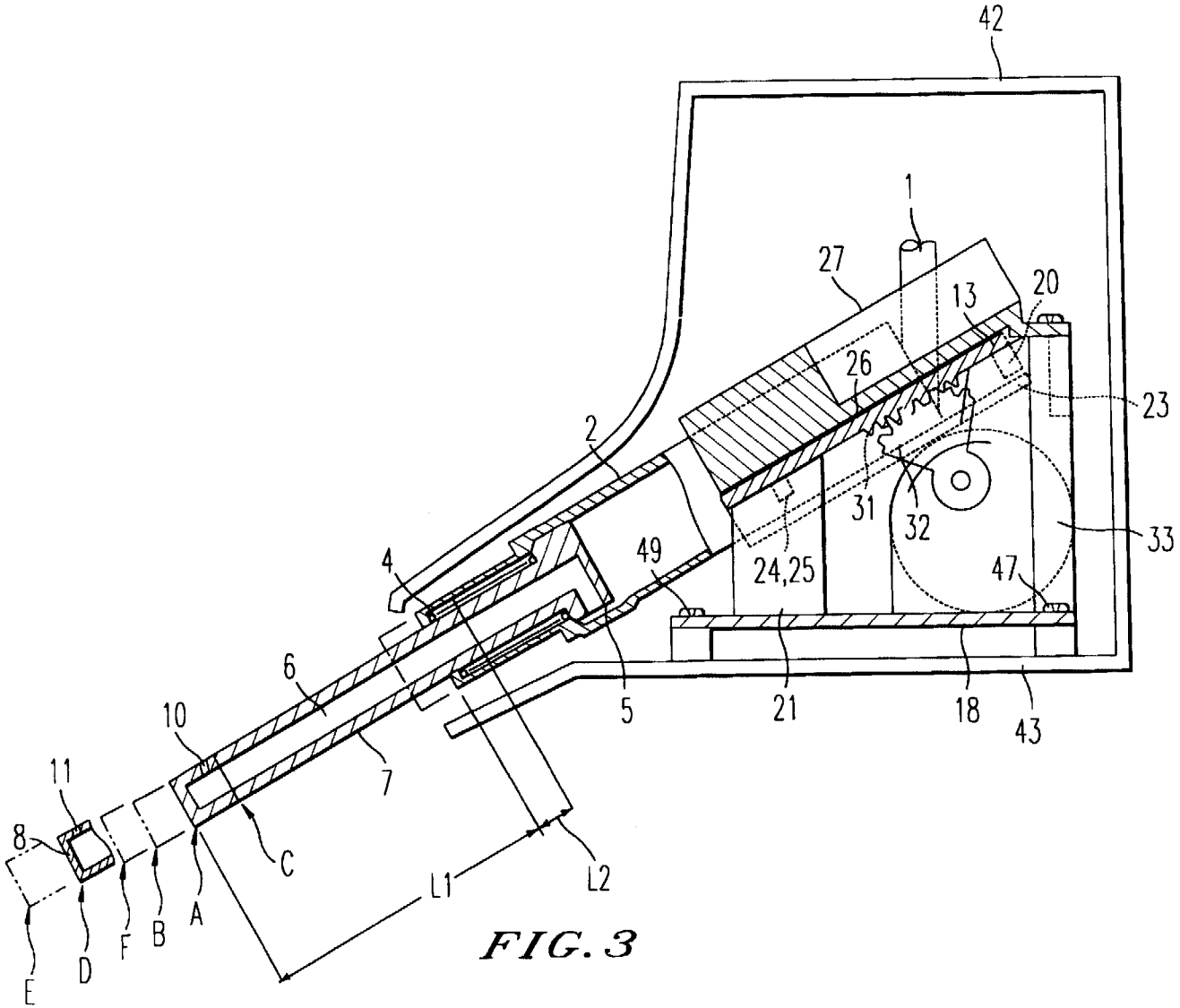
FIG. 3 is a cross sectional view taken along line A—A line of FIG. 2.

Referring to FIG. 1, there is illustrated a human private parts washing apparatus which includes a case 40 and a lavatory seat 41. The case 40 holds a rear end portion of the lavatory seat 41 rotatable to a toilet bowl. The case 40 is formed by a case cover 42 and a base cover 43, and holds a first switch 44 for washing a first position, a second switch 45 for washing a second position, a thermo control sensor 46, a first nozzle 7 for washing the first position, a second nozzle 8 for washing the second position, and other equipment needed for the washing.

As illustrated in FIGS. 2 and 3, a rest 18 which supports a motor 33 is installed on the base cover 43 fasten by screws 47, 48, 49 and 50 at the corner thereof. The rest 18 has rails 19, 20, 21 installed at its center portion and a stand 13 is put on the rails 19, 20, 21. The stand 13 has a rack 31 at its under side thereof in parallel with a the moving of the stand 13. The rack 31 meshes with a pinion 32 installed on a shaft of the motor 33. The stand 13 has a boss 22, 23 out of the rail 19, 20 and a boss 24, 25 out of the rail 21 in order to securely fit to the rest 18. The stand 13 has fixed thereon a first nozzle supporter 2 and a second nozzle supporter 3 via screws 16, 17 and 14, 15 respectively. The first nozzle supporter 2 is fixed as to keep an angle $\alpha$, and the second nozzle supporter 3 is fixed to keep an angle $\beta$ with respect to center-lines S, i.e., the direction of movement of the stand 13 by the rack 31 (shown in FIG. 2). As seen in FIG. 2, the angle $\alpha$ may be about 5° and the angle $\beta$ may be about 12°. Above the first and second nozzle supporters 2 and 3, a plate 27 is fixed, by screws 28, 29, 30, to bosses (not shown) on the rest 18. The plate 27 allows the first and second nozzle supporter 2, 3 not to totter. The first nozzle supporter 2 has an opening 1 to which a water is supplied, and the second nozzle supporter 3 has an opening 9 to which a water is supplied.

A first nozzle 7 is supported in the first nozzle supporter 2 slidably back and forth in a forward inclining manner toward an inner space of a toilet bowl, and has a few first splashing openings 10 at one end thereof for washing the first position. The first nozzle 7 is pushed into the first nozzle supporter 2 by a spring(not shown). A second nozzle 8 is supported in the second nozzle supporter 3, and has a few splashing openings 11 at one end thereof for washing the second position. The second nozzle 8 is similar to the first nozzle 7 except that the second nozzle 8 is longer than the first nozzle 7.

An interrupting plate 35 is installed under the stand 13, and a sensor 34 which detects a location of the stand 13 is installed on the rest 18. The sensor 34 has an emitting part 34*a* and a receptive part 34*b*. When the stand 13 is advanced, the interrupting plate 35 passes between the emitting part 34*a* and the receptive part 34*b*, so that a light emitted from the emitting part 34*a* is interrupted and the location of the stand 13 is detected. The sensor 34 is installed to be able to detect any location of the stand 13.

The operation of this embodiment will be described hereinafter. At first, a case to wash the first position is described. When a user pushes the first switch 44, water is supplied into the opening 1 resulting in that the first nozzle 7 extends to the first nozzle advanced position by the resulting water under pressure against the spring pressure. At the same time the motor 33 moves the stand 13 ahead. So the interrupting plate 35 goes through the sensor 34, and interrupts infrared rays radiated from the emitting part 34*a*. The sensor 34 detects that the interrupting plate 35 is in the first nozzle advanced position and provides a signal to a control means (not shown) to stop the motor 33. Thus the first nozzle 7 is placed at the first washing position. The water supplied to the opening 1 flows into the nozzle supporter 2, a gate 5 and the water-way 6 in the nozzle and at last splashes from the splashing opening 10 toward the first washing position. At this time, the nozzle 7 is extended to a position "A" after a stroke of (L1+L2). "L1" shows a stroke of the first nozzle 7, and "L2" shows a stroke of the nozzle supporter 2.

When the user wants to wash in front of the position A, the user can select "Front switch" which makes the motor 33 to drive to the left in FIG. 3, and the nozzle 7 moves to "B". When the user wants to wash behind the position A, the user can select "Back switch" which makes the motor 33 to drive to the right in FIG. 3, and the nozzle 7 moves to "C". And further when the user wants to wash the first position with optional waving, the user can select "Wave switch" which makes the motor 33 to drive to the left and right, and the nozzle 7 moves to the back and forth. Thus, the first position is washed correctly and effectively.

To stop washing, the user pushes "Stop switch" and the motor 33 rotates to the right in FIG. 3. The nozzle supporter 2 returns to the retracted position. At the same time supplying the water is stopped, and as a result of that the nozzle 7 is retracted into the case 40 by the spring pressure.

Figure 4:
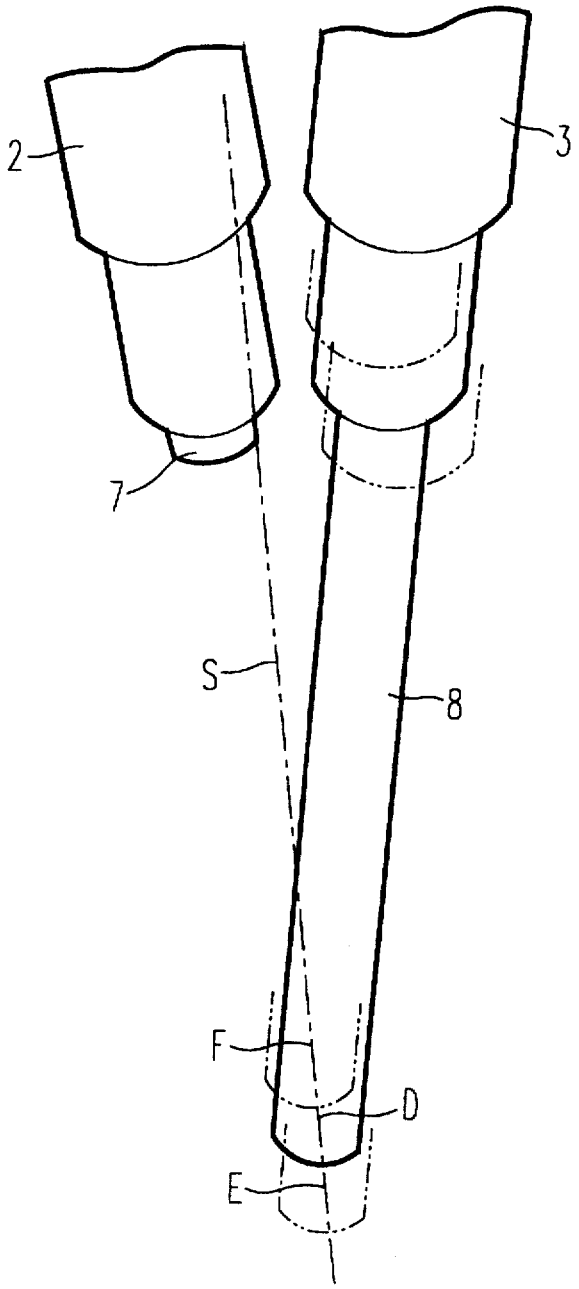
FIG. 4 is a plan view illustrated an action of second nozzle which washes the second position.

In the case of the second nozzle 8, as shown in FIG. 4, the splashing water is usually splashed from the splashing opening 11 of the second nozzle at the standard position "D", and the second nozzle is driven by the motor 33 and the water pressure similar to the first nozzle. Especially, the second nozzle can be moved from a position "E" to a position "F" in FIG. 4.

As mentioned above, according to the present invention, not only the standard position but also the wide position around the standard position can be washed easily and correctly for the abovementioned reason. The difference between the position where the user wants to wash and the standard position of the apparatus can be adjusted by controlling the advanced position of the stand 13 which is moved by the motor 33.

In addition, the opening of the case becomes narrow because each nozzle extends horizontally. Thus filthy water and a detergent and the like do not enter the opening easily on using or cleaning of this apparatus.

Obviously numerous modifications and variations of the present invention are possible in light of the above teachings. It is therefore to be understood that within the scope of the appended claims, the invention may be practiced otherwise than as specifically described herein.

What is claimed is:

1. A human private parts washing apparatus for washing spaced first and second washing positions of a human body, comprising:

a case mounted in proximity to a toilet bowl;

a stand movably mounted to said case for movement between a stand retracted position and at least one stand advanced position;

drive means for driving said stand between said stand retracted position and said at least one stand advanced position;

two nozzle holders mounted to said stand for movement with said stand between said stand retracted and at least one advanced position;

a first nozzle having first splash openings and being mounted in one of said nozzle holders for movement from a first nozzle retracted position to a first nozzle advanced position in which said first splash openings are positioned for splashing water onto a first human private part;

a second nozzle having second splash openings and being mounted in the other one of said nozzle holders for movement from a second nozzle retracted position to a second nozzle advanced position in which said second splash openings are positioned for splashing water onto a second human private part; and means for independently moving said first and second nozzles between said retracted and advanced positions thereof, wherein a first angle $\alpha$ between a direction of movement of said first nozzle between said first nozzle retracted and advanced positions and a direction of movement of said stand between said stand retracted position and said at least one stand advanced position, is substantially smaller than a second angle $\beta$ between a direction of movement of said second nozzle between said second nozzle retracted and advanced positions and the direction of movement of said stand.

2. A human private parts washing apparatus according to claim 1, in which said stand driving means comprises:

a rack which is formed under said stand;

a pinion installed under said rack and meshing with said rack; and a motor driving said pinion.

3. The apparatus of claim 1 wherein said second nozzle is longer than said first nozzle.

4. The apparatus of claim 1 including means for sensing the position of said stand.

* * * * *